US012035801B2

(12) United States Patent
Dunn et al.

(10) Patent No.: US 12,035,801 B2
(45) **Date of Patent: *Jul. 16, 2024**

(54) MAGNETIC BOTTLE BRUSH

(71) Applicant: MUNCHKIN, INC., Van Nuys, CA (US)

(72) Inventors: Steven Bryan Dunn, Beverly Hills, CA (US); Yong Sun Simon Kang, Pasadena, CA (US); Thomas Edward Birkert, West Hills, CA (US); Mark Gerard Tebbe, Ventura, CA (US); Fangyi Gao, Temple City, CA (US); Nicholas Trumbo, Valencia, CA (US); Sung Yun Chan, Pasadena, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/879,453

(22) Filed: Aug. 2, 2022

(65) Prior Publication Data

US 2023/0028280 A1 Jan. 26, 2023

Related U.S. Application Data

(63) Continuation of application No. 16/806,924, filed on Mar. 2, 2020, now Pat. No. 11,399,625.

(60) Provisional application No. 62/898,395, filed on Sep. 10, 2019, provisional application No. 62/812,672, filed on Mar. 1, 2019.

(51) Int. Cl.
*A46B 15/00* (2006.01)
*A46B 17/08* (2006.01)

(52) U.S. Cl.
CPC ..... *A46B 15/0097* (2013.01); *A46B 15/0095* (2013.01); *A46B 15/0061* (2013.01); *A46B 17/08* (2013.01); *A46B 2200/3006* (2013.01)

(58) Field of Classification Search
CPC ..... A46B 15/0095; A46B 15/0097; A46B 2200/3006; A46B 17/08; A47G 29/08; A47K 1/09
See application file for complete search history.

(56) References Cited

U.S. PATENT DOCUMENTS

| | | | | |
|---|---|---|---|---|
| 7,918,620 | B2 * | 4/2011 | Del Ponte | A45C 11/008 401/131 |
| 8,074,666 | B2 * | 12/2011 | Piao | A46B 15/0091 132/313 |
| 9,873,604 | B2 * | 1/2018 | Shin | B67D 1/1405 |
| 11,399,625 | B2 * | 8/2022 | Dunn | A46B 15/0097 |
| 2018/0235354 | A1 * | 8/2018 | Lee | A46B 5/0095 |

* cited by examiner

*Primary Examiner* — Laura C Guidotti
(74) *Attorney, Agent, or Firm* — Robert Z. Evora, Esq.

(57) ABSTRACT

A magnetic bottle brush that has a handle with an upper portion and a lower portion and a brush head attached to the upper portion of the handle. A magnetic element is disposed in the lower portion of the handle that exerts a magnetic attraction force between the magnetic bottle brush and an accompanying magnetic base.

18 Claims, 17 Drawing Sheets

MAGNETIC BOTTLE BRUSH

CROSS REFERENCE TO RELATED APPLICATION

This application is a continuation of U.S. patent application Ser. No. 16/806,924, filed Mar. 2, 2020, now U.S. Pat. No. 11,399,625; which claims priority to U.S. Provisional Application Ser. No. 62/898,395 filed Sep. 10, 2019; and to U.S. Provisional Application Ser. No. 62/812,672 filed Mar. 1, 2019, the contents of which are hereby incorporated by reference herein in their entirety into this disclosure.

TECHNICAL FIELD

The subject disclosure relates generally to a bottle brush with a magnetized handle and a base that attaches the bottle brush through a magnetic attachment.

SUMMARY

A magnetic bottle brush that has a handle with an upper portion and a lower portion and a brush head attached to the upper portion of the handle. A magnetic element is disposed in the lower portion of the handle that exerts a magnetic attraction force between the magnetic bottle brush and an accompanying magnetic base.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the subject disclosure will now be described in greater detail with reference to the figures.

Figure 1:
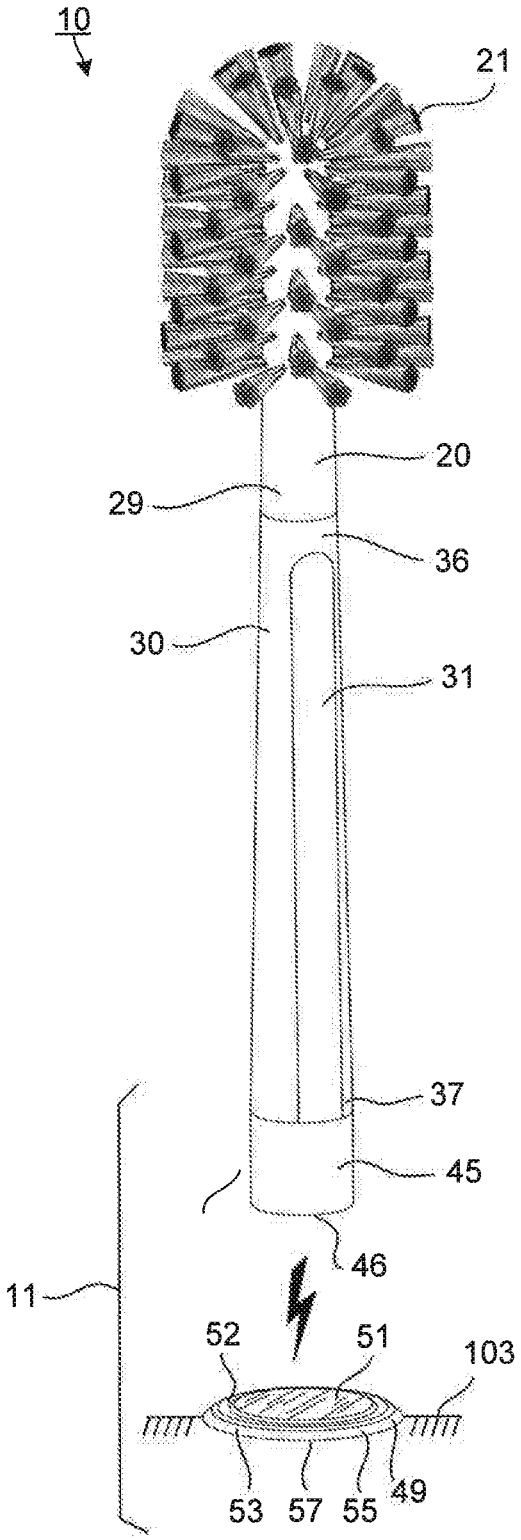
FIG. 1 illustrates a front perspective view of a magnetic bottle brush detached from a magnetic base.
Figure 3:
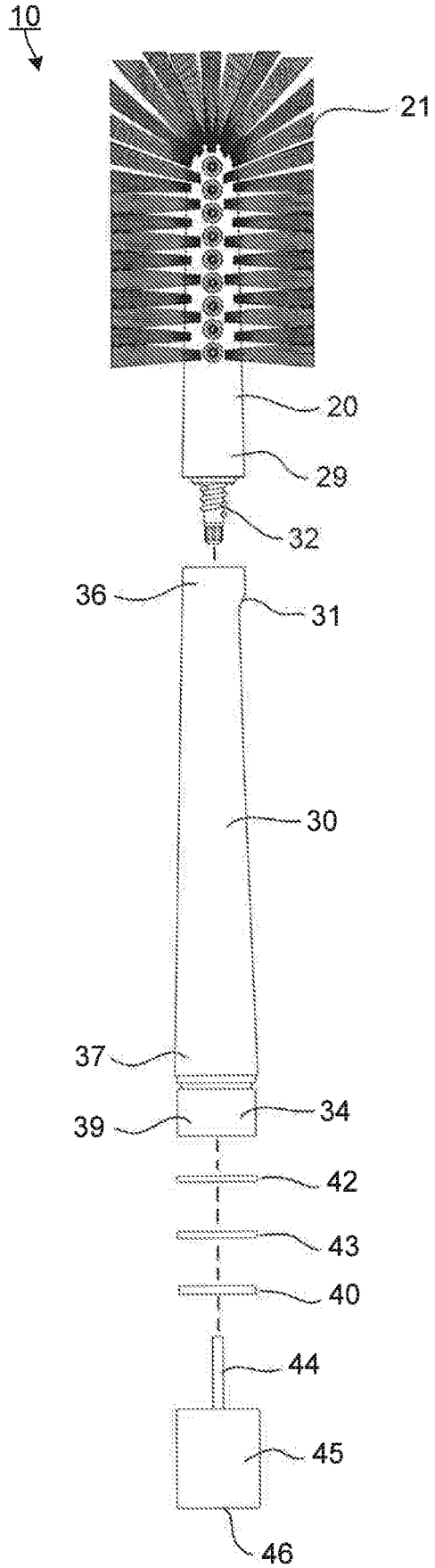
FIG. 3 illustrates an exploded side view of the magnetic bottle brush.
Figure 4:
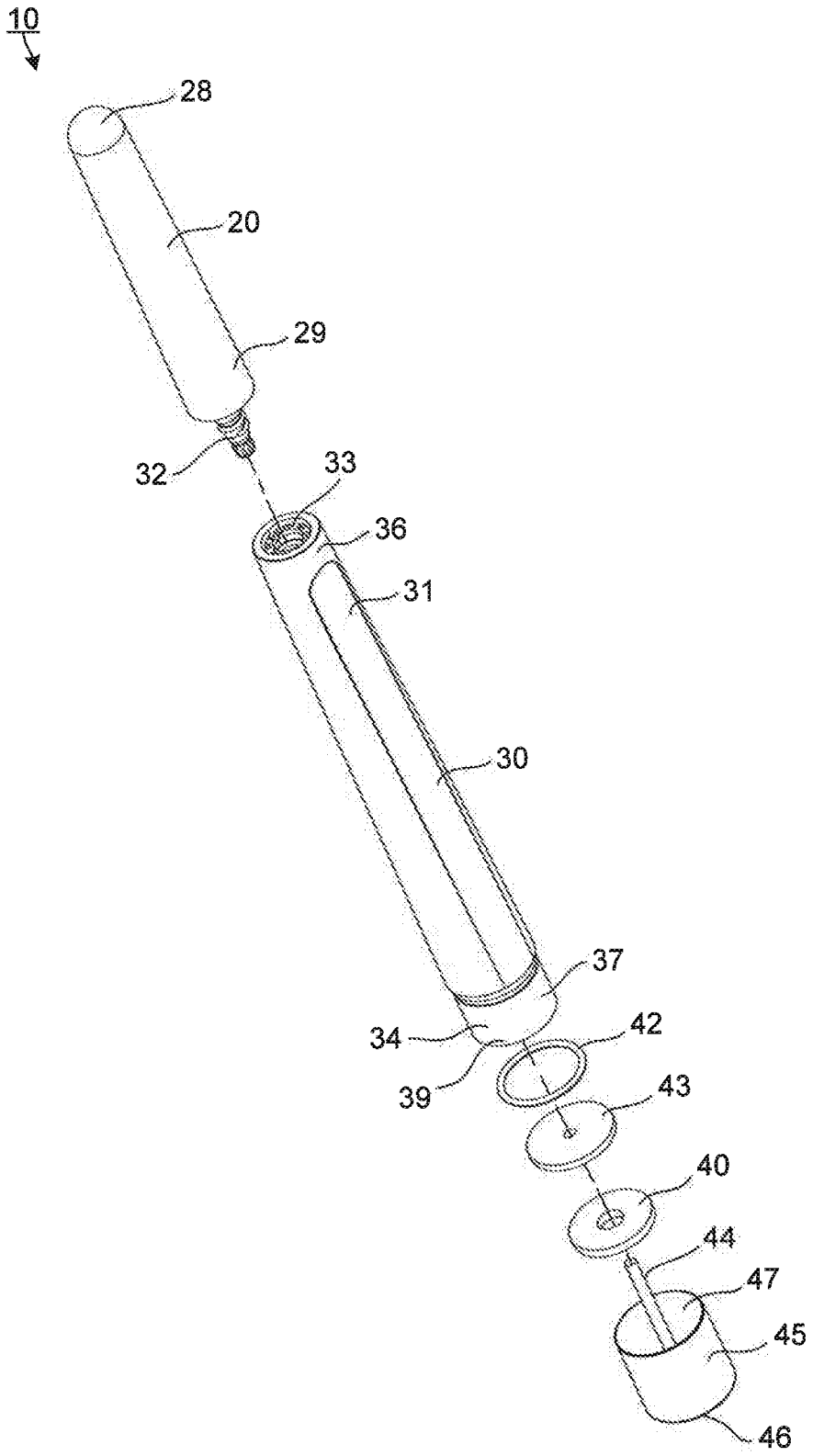
FIG. 4 illustrates an exploded front perspective of the magnetic bottle brush.
Figure 6:
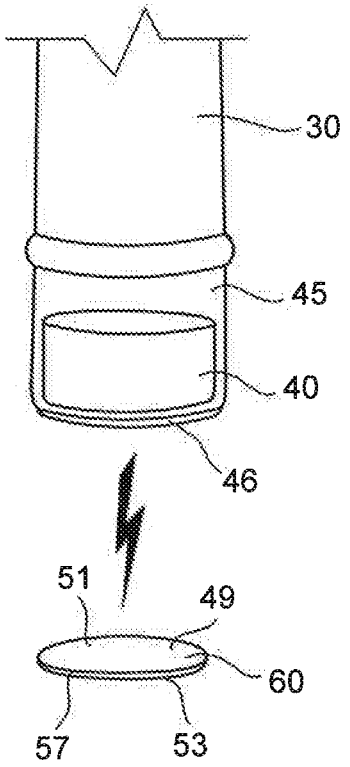
FIG. 6 illustrates a close-up, x-ray view of a magnet inside a magnet housing of the magnetic bottle brush of FIG. 5.

FIG. 1 shows a magnetic bottle brush 10 having a brush head 20 that is detachable, a handle 30 and a magnet 40 (as shown in FIGS. 3, 4 and 6) disposed in a magnet housing 45. The magnetic bottle brush 10 is shown detached from a magnetic base 49. The magnetic base 49 may be attached to an attachment surface 103 such as, but not limited to, a countertop, refrigerator surface, cabinet surface, surface of a sink 101, mirror, appliance, and the like. The magnetic bottle brush 10 may then be securely attached to the magnetic base 49 by way of a magnetic attraction force between the magnetic bottle brush 10 and the magnetic base 49.

The magnet 40 may be a permanent magnet that produces a magnetic field. The magnetic field is invisible and responsible for the force that pulls on other ferromagnetic materials and attracts or repels other magnets. Both magnets and ferromagnetic materials that are attracted to magnets are magnetic. A permanent magnet is an object made from a material that has been magnetized and creates its own persistent magnetic field. Materials that can be magnetized, and are also strongly attracted to magnets 40, are called ferromagnetic or ferrimagnetic and include the elements iron, nickel, cobalt and their alloys, ceramic or ferrite magnets, alinco magnets, injection-molded magnets, some alloys of rare-earth metals (such as samarium-cobalt and neodymium-iron-boron (NIB) magnets), and some naturally occurring minerals such as lodestones. The magnet 40 in the magnetic bottle brush 10, the magnetic base 49, or both may be any of the magnets listed above, or the like.

Figure 2:
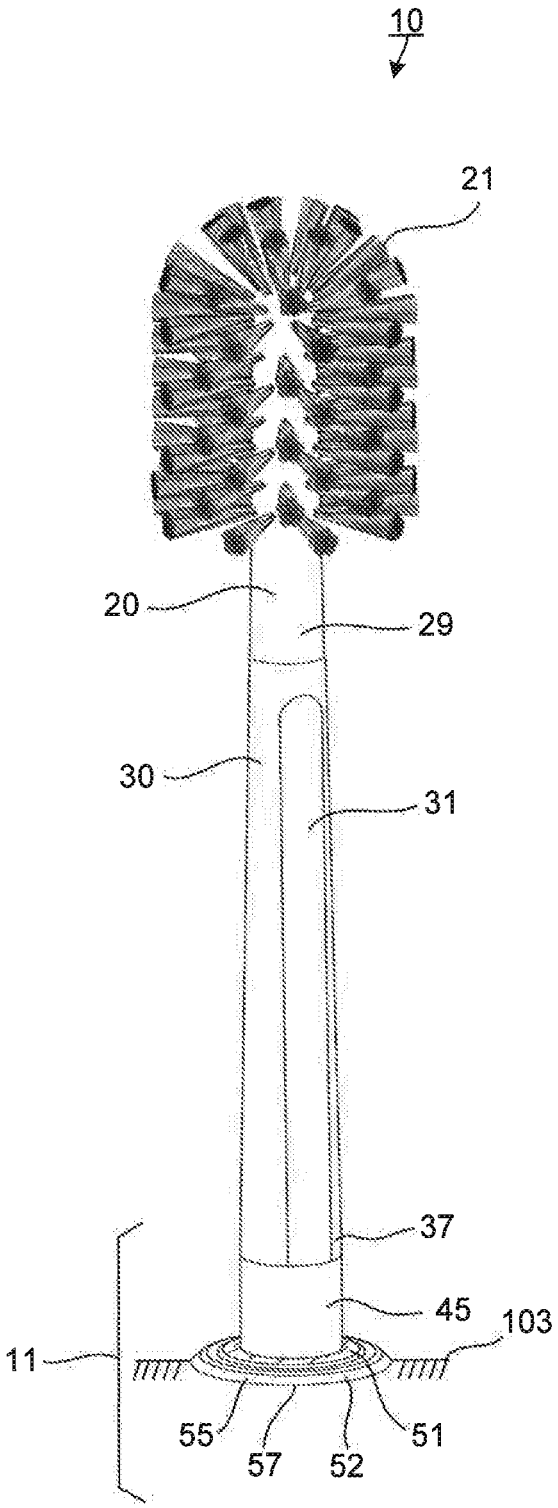
FIG. 2 illustrates a front perspective view of the magnetic bottle brush attached to the magnetic base.

The magnet 40 (FIGS. 3, 4 and 6) disposed in the magnet housing 45 or directly in the handle 30, and the magnetic base 49 together form a magnetic assembly 11. As shown in FIGS. 1-2, the magnet 40 is disposed in the magnet housing 45 of the handle 30, while a top surface 51 of the magnetic base 49 is formed of a ferromagnetic material 60 that is magnetically attracted to the magnet 40. When the magnet 40 and ferromagnetic material 60 are near enough for the magnetic force of attraction to act between them, the magnetic bottle brush 10 is drawn into contact with the magnetic base 49, thereby forming a secure attachment. Alternatively, the magnet 40 may be disposed in the magnetic base 49, with the mating ferromagnetic material 60 disposed in the magnet housing 49 of the magnetic bottle brush 10. It is further contemplated that the magnet 40 may be disposed in both the magnet housing 45 and the magnetic base 49 in a complementary fashion in order to secure the magnetic bottle brush 10 to the magnetic base 49.

FIG. 2 shows the magnetic bottle brush 10 attached to the magnetic base 49 in a vertical, standing position. However, if the magnetic base 49 is attached underneath a surface, on the side of a surface, or on any surface between a vertical and horizontal orientation, then the magnetic bottle brush will extend outward and away from the magnetic base 49 in that respective direction. In the standing position, the magnetic base 49 may be secured to the attachment surface 103 by way of a fastener or adhesive 53 disposed on a bottom surface 57 of the magnetic base 49. Alternatively, if the magnetic base 49 is primarily comprised of a material such as silicone, the magnetic base 49 may adhere to the attachment surface 103 without the need for an adhesive 53 because of attractive forces between the magnetic base 49 and the attachment surface 103 that may be physical, chemical or electrostatic in nature.

As shown in FIG. 2, the magnetic bottle brush 10 may be connected to the magnetic base 49 by way of the magnetic attraction force such that a bottom surface 46 of the magnetic bottle brush 10 makes direct contact with the top surface 51 of the magnetic base 49. It is contemplated that the mating of the magnetic bottle brush 10 with the magnetic base 49 may be accompanied by a satisfying clicking noise, or the like, that audibly alerts a user 5 that a secure connection has been formed.

As shown in FIGS. 1-2, both the bottom surface 46 of the magnetic bottle brush 10 and the top surface 51 of the magnetic base 49 are flat. Alternatively, the contact surfaces 46, 51 of the magnetic assembly 11 may be physically keyed in a matching configuration (not shown). That is, the bottom surface 46 of the magnetic bottle brush 10 may have a curvature, teeth, ridges, waves, at least one protrusion, an extending ring, at least one indentation, or the like that mates with a complementary feature disposed on the top surface 51 of the magnetic base 49.

FIGS. 3-4 illustrate an exploded side view and an exploded upper perspective of the magnetic bottle brush 10 respectively. The brush head 20 of the magnetic bottle brush 10 is detachable from the handle 30 and may be swapped out for an alternate brush head 20 or a replacement when the brush head 20 is worn out. The brush head 20 includes an upper attachment mechanism 32 for securing the brush head 20 to the handle 30. As shown in FIG. 4, the upper attachment mechanism 32 is a threaded portion that mates with a complementary threaded portion in a first core 33 disposed on an upper end 36 of the handle 30. One skilled in the art would recognize that there are numerous ways to affix a brush head to a brush handle, including but not limited to, an internal snap fit, friction fit, locking fit, magnetic attachment, external locking sleeve, and the like.

While the magnet housing 45 may be disposed anywhere on the handle 30 or the brush head 20, as shown in FIGS. 3-4 the magnet housing 45 is disposed on a lower end 37 of the handle 30. The magnet housing 45 may be permanently affixed to the handle 30 or may be detachable from the handle 30. The magnet housing 45 may contain the magnet 40 or the ferromagnetic material 60. As shown in FIGS. 3-4, the magnet housing 45 may be made from any material that does not interfere with the magnetic attachment between the magnetic bottle brush 10 and the magnetic base 49. A spacer 43 that may be compressible may be positioned above or below the magnet 40. An O-ring 42 may also be contained in the magnet housing 45 to help secure the magnet housing 45 to the handle 30 or prevent fluid leakage into the magnet housing 45 or the handle 30 which may be hollow. The magnet housing 45 may have an alignment shaft 44 that helps to align and secure the magnet 40 and spacer 43 within the magnet housing 45. The magnet housing 45 may be removably secured to the lower end 37 of the handle 30 by way of a lower attachment mechanism 34.

As shown by FIGS. 3-4, the magnet housing 45 fits outside the lower end 37 of the handle 30 and is secured by a friction fit between an inner wall 47 of the magnet housing 45 and an outside surface 39 of the lower end 37 of the handle 30. Alternatively, the lower attachment mechanism 34 may be a threaded connection between the magnet housing 45 and the handle 30. Threading may be disposed on the outside of the magnet housing 45 and mate with internal threading disposed in a second core 35 of the handle 30 (FIGS. 11C-11D). Alternatively, internal threading may be disposed on the inner wall 47 inside the magnet housing 45 and may mate with external threading disposed on the outside surface 39 of the lower end 37 of the handle 30 (not shown). It is further contemplated that the lower attachment mechanism 34 may be a snap fit, locking fit, external locking sleeve, or the like for providing a secure fit between the magnet housing 45 and the handle 30.

Figure 5:
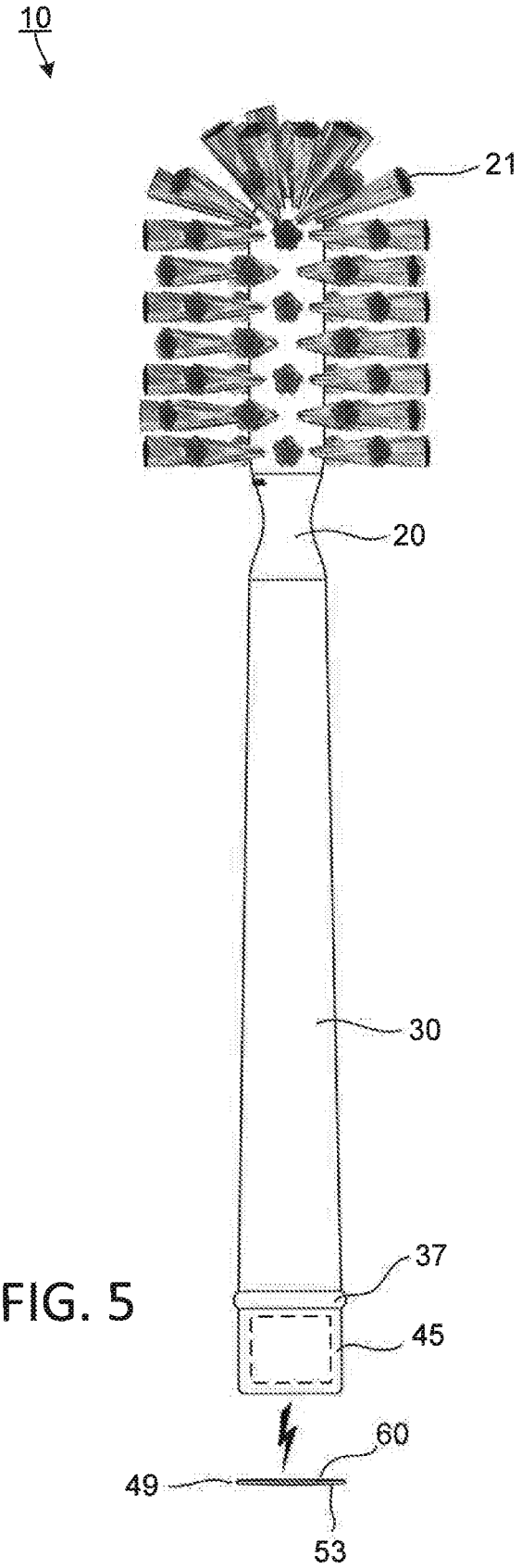
FIG. 5 illustrates a front perspective of a magnetic bottle brush.

FIG. 5 illustrates a magnetic bottle brush 10 detached from a magnetic base 49. As shown in FIG. 5, the magnetic bottle brush 10 has a brush head 20 that is detachable and mates with the handle 30. Disposed at the lower end 37 of the handle 30 is the magnet housing 45. Disposed within the magnet housing 45 may be the magnet 40 or the ferromagnetic material 60.

FIG. 6 is a close-up x-ray view of the lower end 37 of the magnetic bottle brush 10 shown in FIG. 5, along with an upper perspective of the magnetic base 49. The magnet 40 may be permanently affixed or removably secured within the magnet housing 45 by way of an adhesive, friction fit, snap fit, keyed fit, or the like.

The magnetic base 49 shown in FIGS. 5-6 has a top surface 51 formed of the ferromagnetic material 60. On the bottom surface 57 of the magnetic base 49 may be the adhesive 53 that secures the magnetic base 49 to the desired attachment surface 103. The magnetic base 49 may be secured at various locations on the sink 101 or the countertop. Alternatively, the magnetic base 49 may be secured on the side of a cabinet, refrigerator, wall, or like surface, such that the magnetic bottle brush 10 extends horizontal and orthogonal from the attachment surface 103. The magnetic base 49 may also be secured underneath a cabinet, or like surface, such that the magnetic bottle brush 10 hangs from the attachment surface 103.

Figure 7:
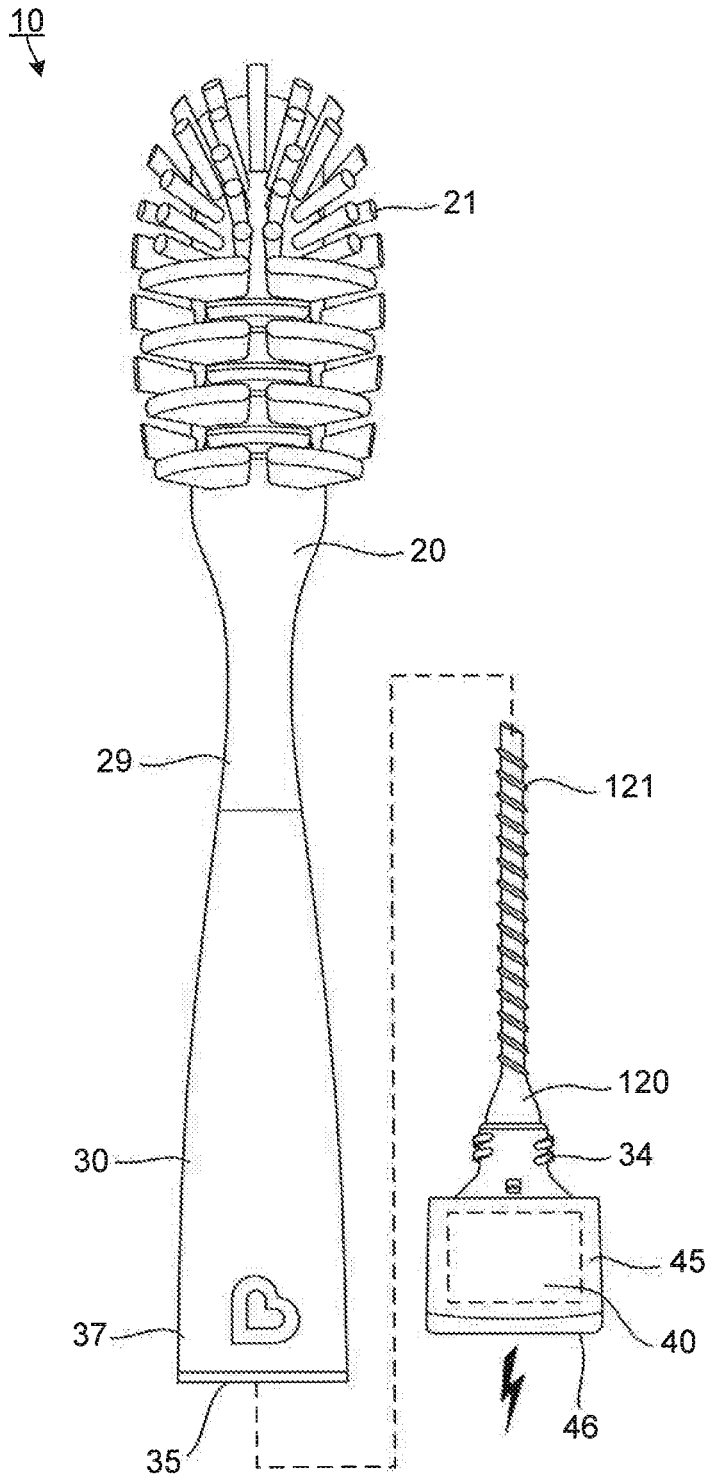
FIG. 7 illustrates a front view of a magnetic bottle brush with a magnet disposed in a detachable nipple brush.

FIG. 7 illustrates the magnetic bottle brush 10 with the brush head 20 that is detachable, the handle 30 and a detachable nipple brush 120 that is removably attached within the handle 30. The detachable nipple brush 120 is configured to conveniently scrub bottle nipples with the nipple brush bristles 121 disposed at the top portion 122 of the detachable nipple brush 120. The detachable nipple brush 120 has the lower attachment mechanism 34 embodied as a threaded connection that secures the detachable nipple brush 120 within a second core 35 disposed in the lower end 37 of the handle 30. The magnet housing 45 is disposed on the bottom of the detachable nipple brush 120 with a magnet 40 disposed therein. When the detachable nipple brush 120 is attached to the handle 30, the entire magnetic bottle brush 10 may be attached to the magnetic base 49 for storage. Furthermore, when the detachable nipple brush 120 is stored within the handle 30, the detachable nipple brush 120 is insulated against contact with germ-laden surfaces such as countertops, sinks, or other utensils.

Alternatively, the detachable nipple brush 120 may be releasably attached within the handle 30 by an interference fit, a twist fit, snap-in fit or any other suitable lower attachment mechanism 34 that is releasable. An interference fit would be constructed to withstand a withdrawal force when locked that would at least exceed the entire weight of the magnetic bottle brush 10, so that the entire magnetic bottle brush 10 may be hung securely due to the strength of the magnetic attraction force present in the magnet 40 disposed in the magnet housing 45 of the detachable nipple brush 120. It is also contemplated that the attachment between the detachable nipple brush 120 and the handle 30 may be magnetic. In such a configuration (not shown), a single magnet 40 disposed in the detachable nipple brush 120 or the handle 30 may connect these elements together and secure the magnetic bottle brush 10 to the magnetic base 49.

Figure 8A:
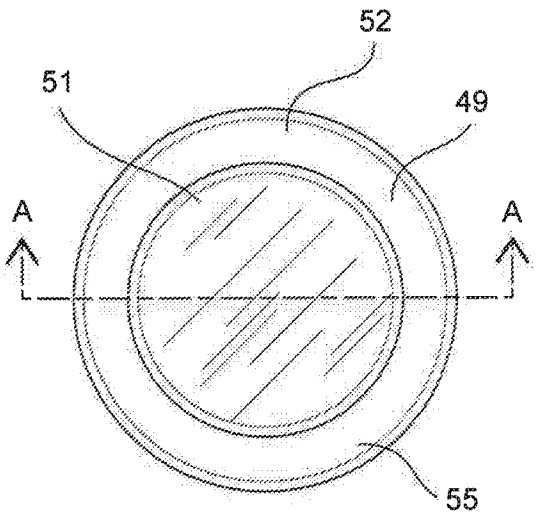
FIG. 8A illustrates a top view of the magnetic base.
Figure 8B:
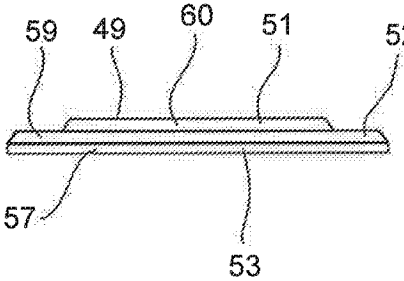
FIG. 8B illustrates a side view of the magnetic base of FIG. 8A.

FIGS. 8A-10C detail various views and possible features of the magnetic base 49. FIG. 8A is a top view of the magnetic base 49. FIG. 8B is a side view of the magnetic base 49. The magnetic base 49 has a top surface 51 that is formed from a ferromagnetic material 60, a perimeter 52 that extends around the ferromagnetic material 60 and a bottom surface 57. The top surface 51 of the magnetic base 49 is adapted to physically contact the bottom surface 46 of the magnetic bottle brush 10 while the magnetic bottle brush 10 is attached to the magnetic base 49 because of the magnetic attraction force between these elements. The magnetic base 49 may be secured to a non-magnetic surface by way of the fastener or adhesive 53, mechanical bonding and/or any other means such that the magnetic base 49 remains attached to the attachment surface 103 while the magnetic bottle brush 10 is magnetically secured therein. In the embodiment shown in FIGS. 8A-10C, the adhesive 53 is disposed on the bottom surface 57 of the magnetic base 49.

The top surface 51 is embedded within a secondary material 55 that may be considered a housing 59. The top surface 51 may be embedded in the housing 59 through co-molding, overmolding, secondary manufacturing processes such as stamping, snap-fitting, application of adhesives, and the like. As shown in the cross-section of FIG. 8C, the top surface 51 is exposed, while a peripheral edge 58 extends underneath the secondary material 55. The peripheral edge 58 serves as the substrate for the co-molding of the secondary material 55 onto the top surface 51.

As shown in FIGS. 8A-9C, the secondary material 55 is made from silicone. However, the secondary material 55 may be formed of, polyethylene, plastics, woven polypropylene plastic, mixed plastics, thermoplastic elastomers, elastomers, ethylene propylene rubber, ethylene propylene diene rubber, epichlorohydrin rubber, polyacrylic rubber, fluorosilicone rubber, fluoroelastomers, perfluoroelastomers, polyether block amides, chlorosulfonated ethylene-vinyl acetate, thermoplastic elastomers, resilin, elastin, polysulfide rubber, elastolefin, synthetic polyisoprene, polybutadiene, chloroprene rubber, polychloroprene, neoprene, baypren, butyl rubber, halogenated butyl rubbers, styrene-butadiene rubber, nitrile rubber (Buna N rubbers), hydrogenated nitrile rubbers, Therban, or zetpo, rubber, metal, wood, fabrics, water-resistant textiles, and the like, or any combination of the above, which are capable of containing a magnet 40 or ferromagnetic material 60 without interfering with the magnetic attachment between the magnetic bottle brush 10 and the magnetic base 49.

Figure 8C:
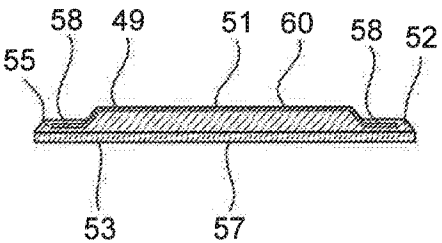
FIG. 8C illustrates a rear-facing cross-section of the magnetic base about the line A-A shown in FIG. 8A.
Figure 8E:
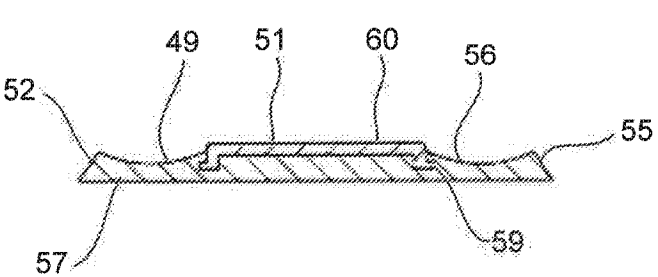
FIG. 8E illustrates an alternate cross-section of the magnetic base with a run-off channel that encircles the top surface.
Figure 8D:
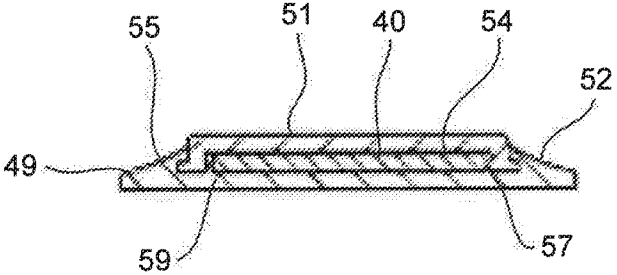
FIG. 8D illustrates an alternate rear-facing cross-section of the magnetic base about the line A-A shown in FIG. 8A.

FIGS. 8C-8E illustrate cross-sections of the magnetic base 49 about the line A-A shown in FIG. 8A. As shown in FIG. 8C, the top surface 51 of the magnetic base 49 may be a ferromagnetic material 60 embedded at the peripheral edge 58 within a secondary material 55. The ferromagnetic material 60 may extend into the perimeter 52 of the magnetic base 49. The secondary material 55 may be permanently affixed or removably attached to an adhesive 53 that forms the bottom surface 57 of the magnetic base 49. The bottom surface 57 may include a cover (not shown) for protecting and covering the adhesive 53 before adhering the magnetic base 49 to the attachment surface 103. Alternatively, as shown in FIGS. 8D-8E, the magnetic base 49 is primarily comprised of silicone that will adhere to the attachment surface 103 without the need for an adhesive 53 because of attractive forces between the magnetic base 49 and the attachment surface 103 that may be physical, chemical or electrostatic in nature.

As shown in FIG. 8D, the top surface 51 of the magnetic base 49 may be a nonmagnetic material overmolded with a secondary material 55. Beneath the top surface 51 that is nonmagnetic may be an embedded portion 54. The embedded portion 54 may be the magnet 40 or the ferromagnetic material 60. The magnetic base 49 with the embedded portion 54 is adapted to mate with the magnetic bottle brush 10 with a complementary magnet 40 (north pole of the magnet 40 in the magnetic base 49 mating with the south pole of the magnet 40 in the magnet housing 45 of the handle 30) or the ferromagnetic material 60 disposed in the magnet housing 45 or the lower end 37 of the handle 30.

As shown in FIG. 8E, the top surface 51 of the magnetic base 49 may be the ferromagnetic material 60 embedded within, or comolded with, the secondary material 55. Between the perimeter 52 of the magnetic base 49 and the top surface 51 may be a run-off channel 56 that encircles the top surface 51. The run-off channel 56 catches liquid that may drain off of the magnetic bottle brush 10 when it is wet and attached to the magnetic base 49 just after use.

Figure 9A:
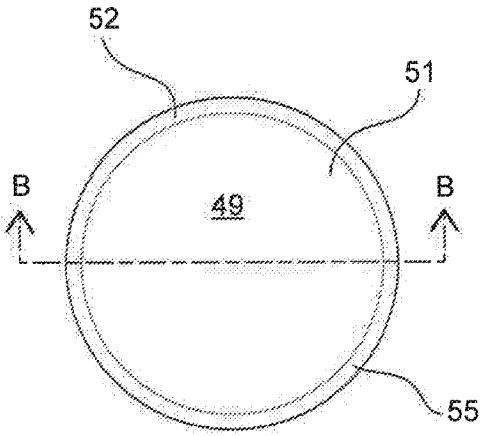
FIG. 9A illustrates a top view of a magnetic base.
Figure 9B:
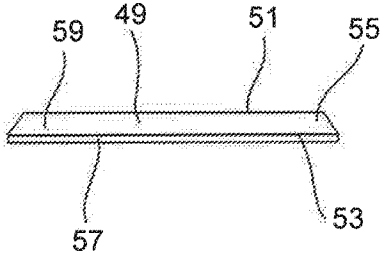
FIG. 9B illustrates a side view of the magnetic base of FIG. 9A.
Figure 9C:
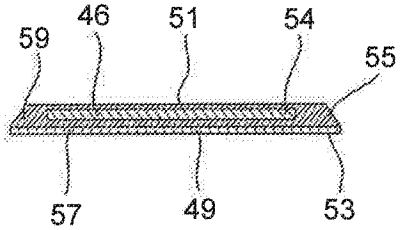
FIG. 9C illustrates a rear-facing cross-section of the magnetic base about the line B-B shown in FIG. 9A.

FIGS. 9A-9C illustrate the magnetic base 49 with the embedded portion 54 disposed in the housing 59 formed by the secondary material 55. The embedded portion may be the ferromagnetic material 60 or the magnet 40. As shown in FIGS. 9A-9C, the magnetic base 49 has the top surface 51 and the bottom surface 57. The bottom surface 57 may have the fastener or adhesive 53 for securing the magnetic base 49 to the attachment surface 103. The top surface 51 is formed of the secondary material 55. The embedded portion 54, in this embodiment the magnet 40, is not visible from either the top surface 51, bottom surface 57 or perimeter 52 of the magnetic base 49 and is fully enclosed by the housing 59 formed by the secondary material 55.

Figure 10A:
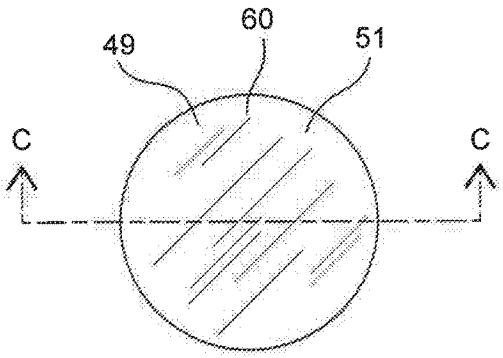
FIG. 10A illustrates a top view of a magnetic base.
Figure 10B:
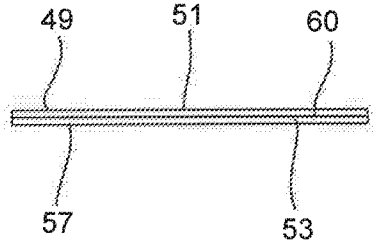
FIG. 10B illustrates a side view of the magnetic base of FIG. 10A.
Figure 10C:
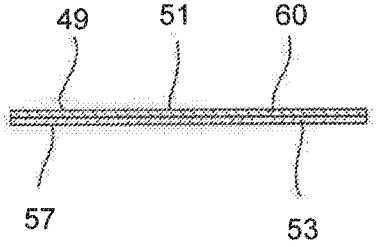
FIG. 10C illustrates a rear-facing cross-section of the magnetic base about the line C-C shown in FIG. 10A.

FIGS. 10A-10C illustrate a magnetic base 49 that has the top surface 51 and the bottom surface 57. The top surface 51 is formed of the ferromagnetic material 60 or the magnet 40, while the bottom surface 57 may have the adhesive 53, or other suitable attachment or fastener according to this subject disclosure, affixed therein.

Figure 11A:
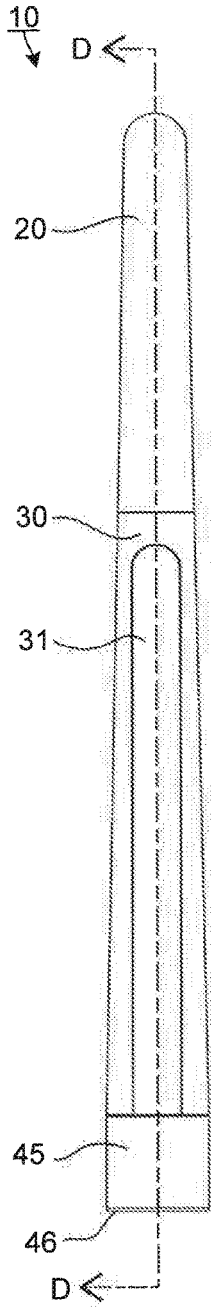
FIG. 11A illustrates a front view of the magnetic bottle brush with a brush head without bristles.
Figure 11B:
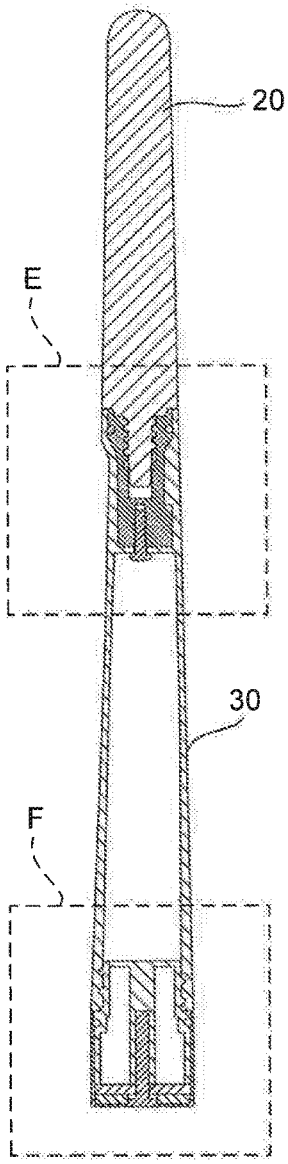
FIG. 11B illustrates a left-facing cross-section of the magnetic bottle brush about line D-D shown in FIG. 11A.
Figure 11C:
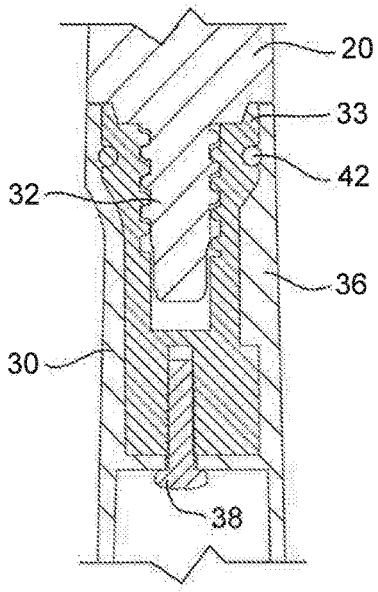
FIG. 11C illustrates a close-up view of section E shown in FIG. 11B.
Figure 11D:
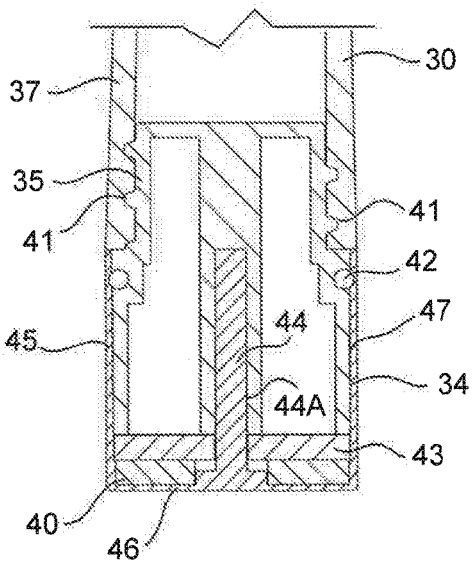
FIG. 11D illustrates a close-up view of section F shown in FIG. 11B.

FIG. 11B is a left-facing cross-section of the magnetic bottle brush 10 without bristles 21 taken about line D-D shown in FIG. 11A. FIG. 11C is an enlarged view of subsection E from FIG. 11B showing the attachment between the brush head 20 that is detachable and the handle 30 in greater detail. As shown in FIG. 11C, the brush head 20 may include the upper attachment mechanism 32. The upper attachment mechanism 32 may be a threaded fastener that mates with a complementary threaded portion in the first core 33. The first core 33 is disposed at the upper end 36 of the handle 30 and secured to the handle 30 by way of an upper core fastener 38. The upper core fastener 38 may be pin with or without threading. Alternatively, the first core 33 may be permanently affixed to the upper end 36 of the handle 30 in a variety of different ways, such as by sonically welding, an adhesive, a mechanical fastener and/or any other suitable attachment according to this subject disclosure.

FIG. 11D illustrates an enlarged close-up of subsection F from FIG. 11B that shows the interior of the magnet housing 45 when fully assembled and attached to the handle 30 of the magnetic bottle brush 10. As shown in FIG. 11D, the magnet housing 45 attaches to the second core 35 disposed at the lower end 37 of the handle 30. The second core 35 is secured to the handle 30 through a series of ridges disposed on the outside of the second core 35 that lock into place within complementary grooves 41 disposed in the interior of the handle 30. The magnet housing 45 is secured to the second core 35 by way of the lower attachment mechanism 34.

As shown in FIG. 11D, the lower attachment mechanism 34 is a friction fit between the exterior of the second core 35 and an inner wall 47 of the magnet housing 45. The O-ring 42 is squeezed between the inner wall 47 of the magnet housing 45 and the exterior of the second core 35. The magnet housing 45 is further secured to the second core 35 by the interaction between the alignment shaft 44 disposed in the interior of the magnet housing 45 and an alignment channel 44A disposed in the second core 35. The alignment shaft 44 extends vertically through the magnet housing 45 and helps to orient and secure the magnet 40 and spacer 43 within the magnet housing 45. When the magnet housing 45 is attached to the second core 35, the alignment shaft 44 fits within the alignment channel 44A to align the magnet housing 45 and the second core 35 for a secure fit.

Figure 12A:
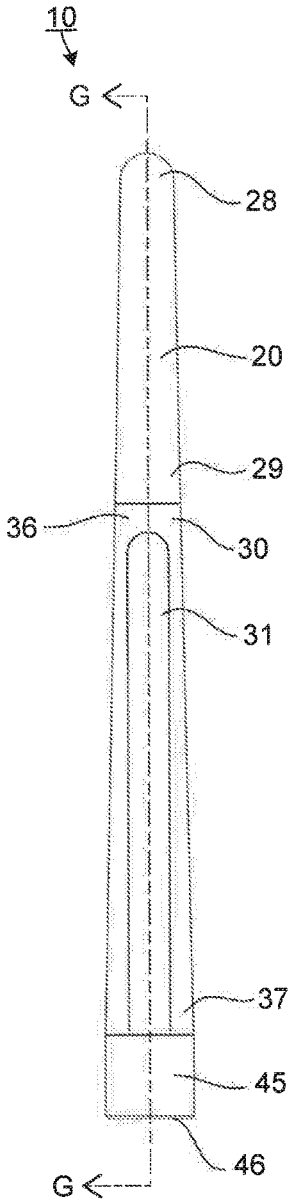
FIG. 12A illustrates a front view of the magnetic bottle brush with a brush head without bristles.
Figure 12B:
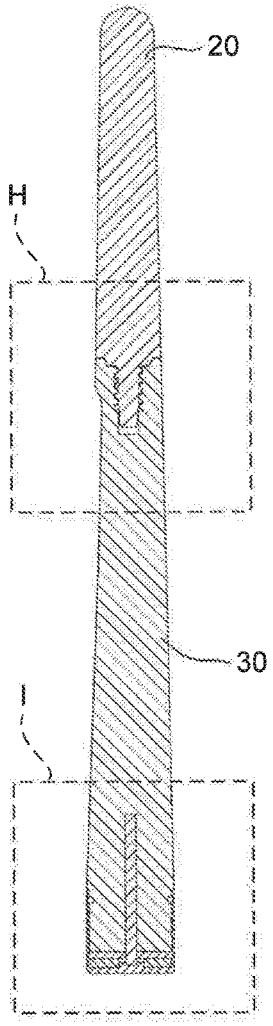
FIG. 12B illustrates a left-facing cross-section of the magnetic bottle brush about line G-G shown in FIG. 12A.
Figure 12C:
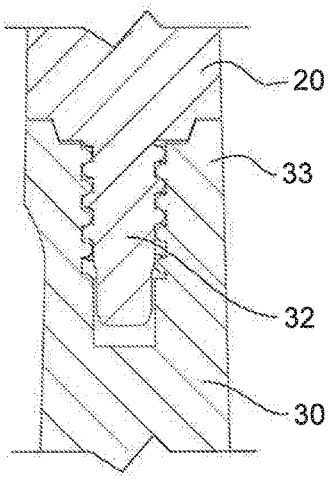
FIG. 12C illustrates a close-up view of section H shown in FIG. 12B.

FIG. 12B is a left-facing cross-section of the magnetic bottle brush 10 without bristles 21 taken about line G-G shown in FIG. 12A. FIG. 12C is an enlarged view of subsection H from FIG. 12B that shows the attachment between the brush head 20 that is detachable and the handle 30 in greater detail. As shown in FIG. 12C, the brush head 20 may include the upper attachment mechanism 32. In the embodiment shown, the upper attachment mechanism 32 is a threaded fastener that mates with a complementary threaded portion in the handle 30. Alternatively, the upper attachment mechanism 32 may be, but not limited to, an internal snap fit, friction fit, locking fit, magnetic attachment, external locking sleeve, and the like.

Figure 12D:
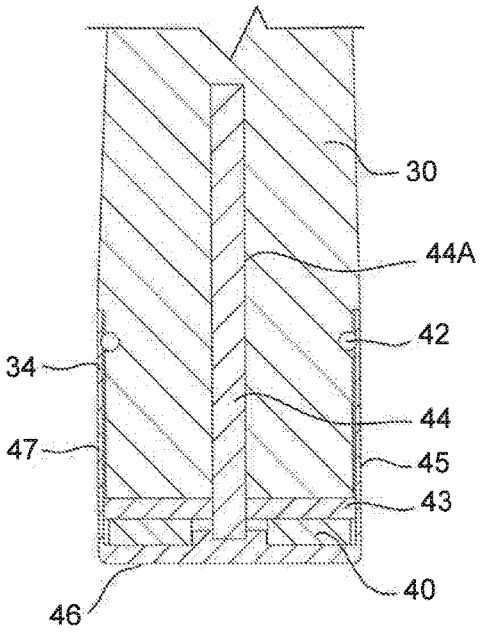
FIG. 12D illustrates a close-up view of section I shown in FIG. 12B.

FIG. 12D illustrates an enlarged close-up of subsection I from FIG. 12B that shows the interior of the magnet housing 45 when fully assembled and attached to the handle 30 of the magnetic bottle brush 10. As shown by FIG. 12D, the magnet housing 45 slides over the outer surface 39 of the lower end 37 of the handle 30 and is secured by a friction fit. The O-ring 42 is squeezed between the inner wall 47 of the magnet housing 45 the outer surface 39 of the lower end 37 of the handle 30 in order to create greater friction between the handle 30 and the magnet housing 45. The O-ring 42 may also prevent liquid leakage into the magnet housing 45. The magnet housing 45 is further secured to the handle 30 by the interaction between the alignment shaft 44 disposed in the interior of the magnet housing 45 and the alignment channel 44A disposed in the handle 30. The alignment shaft 44 extends vertically through the magnet housing 45 and helps to orient and secure the magnet 40 and spacer 43 within the magnet housing 45. When the magnet housing 45 is attached to the handle 30, the alignment shaft 44 fits within the alignment channel 44A to align the magnet housing 45 and the handle 30 for a secure fit.

Figure 13C:
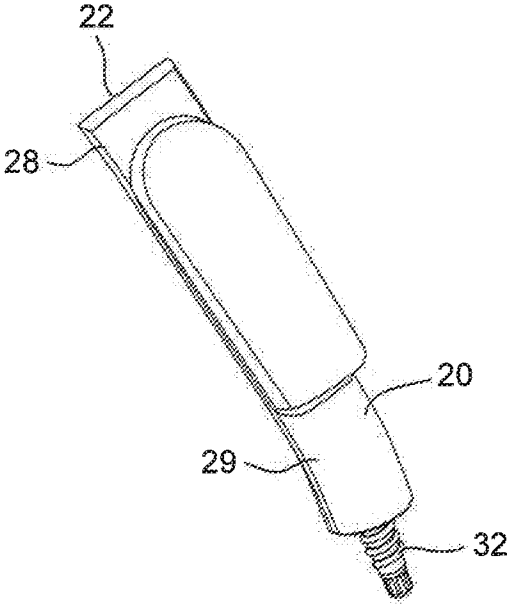
FIG. 13C illustrates a front perspective view of the detachable brush head of FIG. 13B without bristles.
Figure 13B:
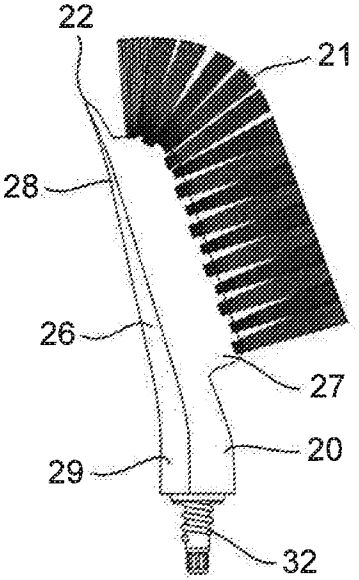
FIG. 13B illustrates a side view of a detachable brush head with a scraper.
Figure 13A:
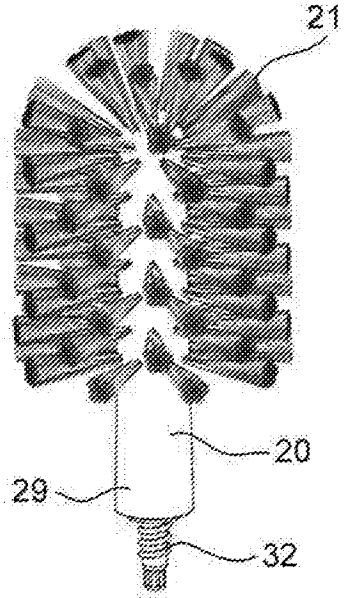
FIG. 13A illustrates a front view of a detachable brush head.

FIGS. 13A-13C illustrate various examples of brush heads 20 that are detachable and may be attached to the handle 30 of the magnetic bottle brush 10. Different brush heads 20 are suited for cleaning different items and surfaces. The brush head 20 may be a sponge, a bristle brush, a molded silicon bristle brush, a wire brush, a nipple brush and/or other various brush heads to name a few of the possible brush head configurations. The brush head 20 may also include a scraper 22 or other features designed to abrasively clean surfaces, such as flat, tight or narrow spaces. The brush head 20 may be attached to the handle 30 by way of a threaded connection. The handle 30 is configured to mate with different brush heads 20. As shown, the brush heads 20 attach to the handle 30 by way of a threaded connection. One skilled in the art would recognize that there are numerous ways to affix a brush head to a brush handle, including but not limited to, an internal snap fit, friction fit, locking fit, magnetic attachment, external locking sleeve, and the like according to this subject disclosure.

Figure 14A:
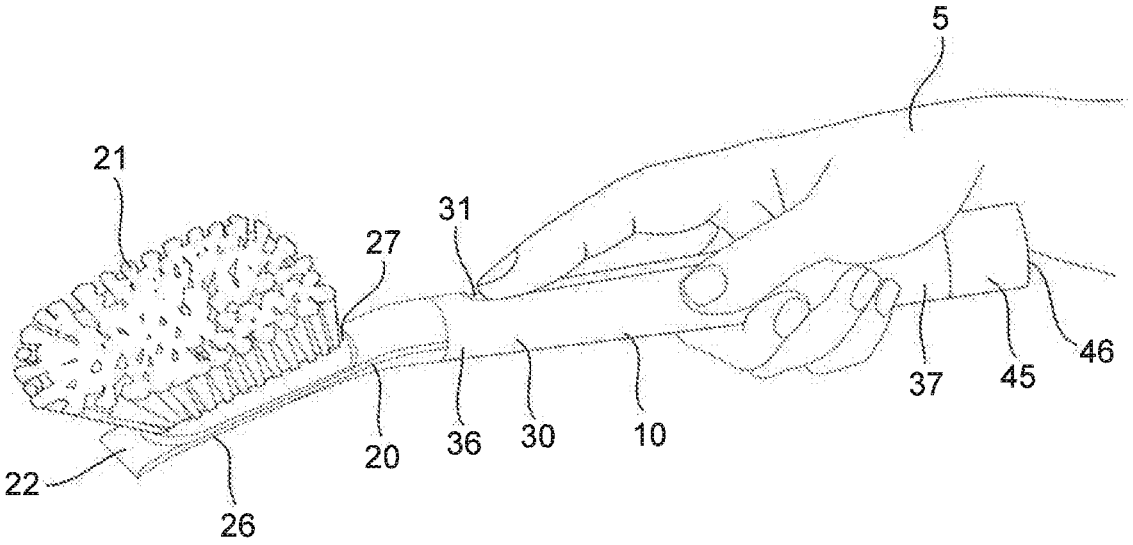
FIG. 14A illustrates a side perspective view of the magnetic bottle brush in use.
Figure 14B:
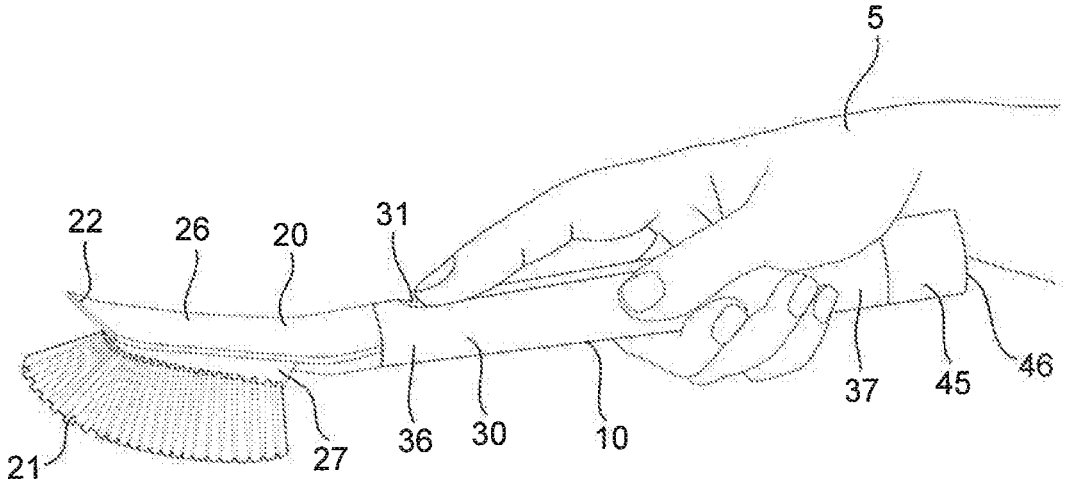
FIG. 14B illustrates an alternate side view of the magnetic bottle brush in use.

FIGS. 14A-14B illustrate the magnetic bottle brush 10 operated by a user 5. A grip feature or depression 31 disposed in the handle 30 provides the user 5 with leverage when using the magnetic bottle brush 10. Alternatively, the grip feature 31 may be a projection, undulation, ridge, channel, series or combination of the above, or the like for providing leverage or grip for the user 5. In FIG. 14A, the user 5 has installed the brush head 20 that is detachable such that the grip depression 31 and the bristles 21 of the brush head 20 are facing in the same direction. From this use position, the user 5 can gain leverage when using the bristles 21 to scrub by utilizing the grip feature 31 with an index or a middle finger of a hand. The user 5 may also utilize the scrapper 22 from this use position, such that a thumb of the user 5 interacts with the grip depression 31 to generate leverage.

In FIG. 14B, the user 5 has installed the brush head 20 on the handle 30 such that the grip depression 31 and the bristles 21 are oriented in opposite directions. From this use position, the user 5 may scrub with the bristles 21 while using a thumb, index finger or middle finger with the grip depression 31 to generate leverage. The magnetic bottle brush 10 may also be turned over to use the scrapper 22, such that the grip depression 31 is used with the index finger or middle finger to generate leverage. The brush head 20 may be attached to the handle 30 such that the brush head 20 may easily be rotated from a front to back position in order to use the grip depression 31 as desired. With an alternate brush head 20 that has bristles 21 surrounding the entirety of the brush head 20, the user 5 may simply rotate the magnetic bottle brush 10 to position the grip depression 31 for use as desired.

Figure 15:
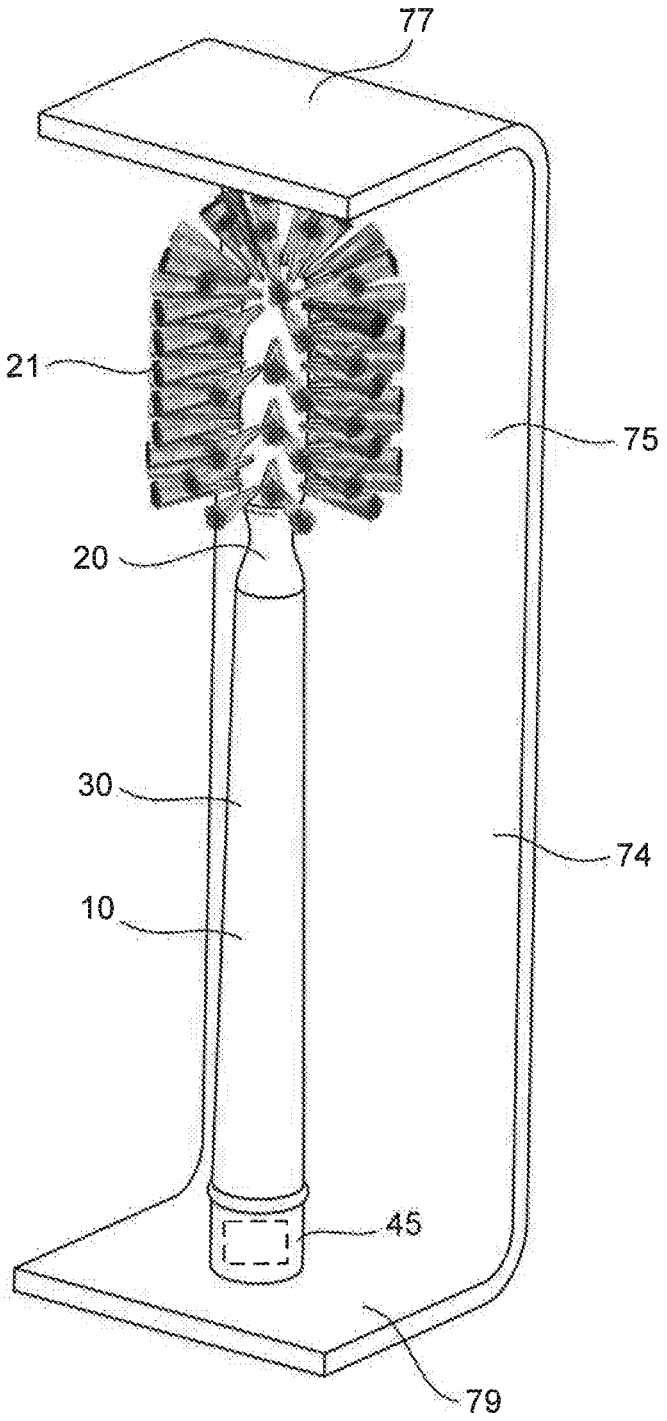
FIG. 15 illustrates a front perspective view of the magnetic bottle brush attached and standing within a magnetic brush frame.
Figure 16:
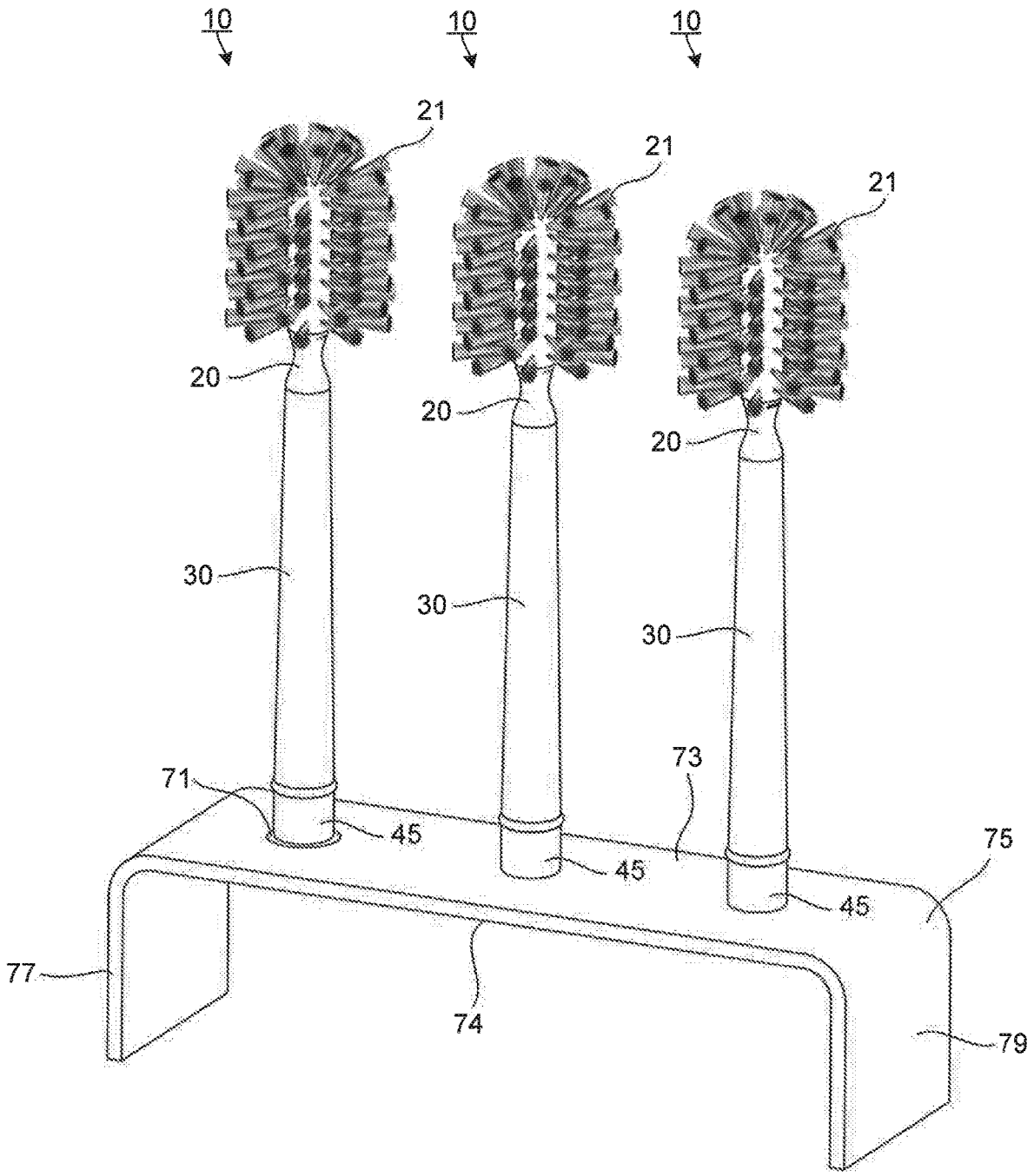
FIG. 16 illustrates a front perspective view of several magnetic bottle brushes standing and attached to a top surface of the magnetic brush frame.

FIGS. 15-16 illustrate magnetic bottle brushes 10 attached to a brush frame 75 in a variety of use positions. The brush frame 75 has a top surface 73 and a bottom surface 74, with a left sidewall 77 and a right sidewall 79. All of the surfaces of the brush frame 75 may be magnetic, but it is all possible to make the brush frame 75 with one or more nonmagnetic surfaces with at least one magnetic point of attachment 71 contained therein. The brush frame 75 can be utilized in numerous positions for attaching the magnetic bottle brush 10 or multiple magnetic bottle brushes 10.

As shown in FIG. 15, the brush frame 75 can stand on a left sidewall 77 or a right sidewall 79 to provide storage for a standing or hanging magnetic bottle brush 10. When utilizing a sidewall 77, 79 storage position, the magnetic bottle brush 10 may either stand on the inside of the bottom sidewall 77, 79, or hangs from the inside of the opposite sidewall 77, 79.

As shown in FIG. 16, in a horizontal standing position, the brush frame 75 rests on the left sidewall 77 and the right sidewall 79 with an elevated top surface 73 for attaching the magnetic bottle brushes 10. The brush frame 75 may be turned upside down to accommodate magnetic bottle brushes 10 attached to the bottom surface 74 in a standing position. Both the top surface 73 and the bottom surface 74 can accommodate the attachment of multiple magnetic bottle brushes 10 at any time.

Figure 17:
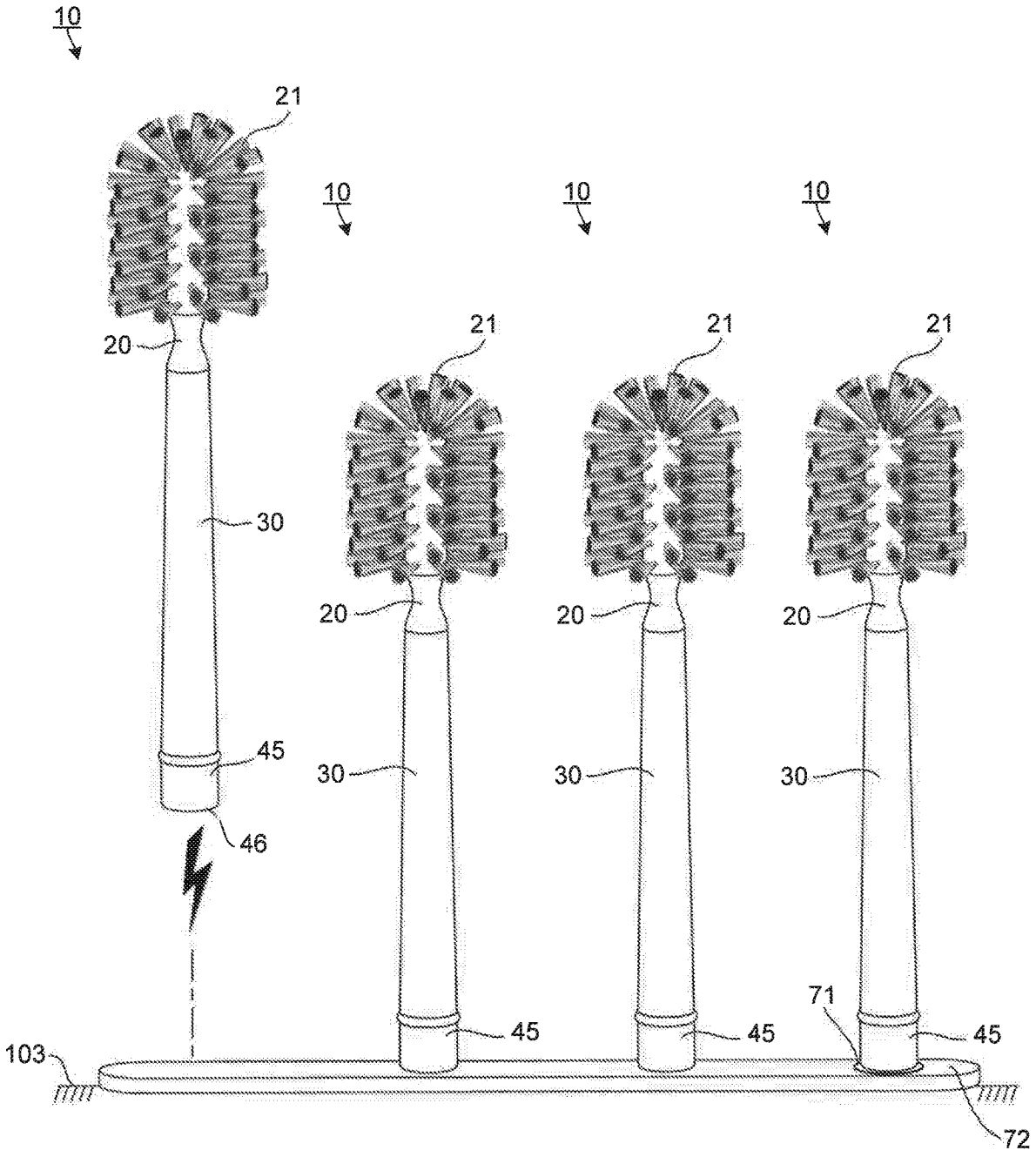
FIG. 17 illustrates a front view of several magnetic bottle brushes attached to a magnetic attachment strip and one magnetic bottle brush detached from the magnetic attachment strip.

FIG. 17 illustrates an attachment strip 72 for storing magnetic bottle brushes 10 in either a standing or hanging (if turned over upside down) storage configuration. The attachment strip 72 may be made of the ferromagnetic material 60 or may be made of any suitable material with magnetic points of attachment 71 formed therein. The attachment strip 72 may be affixed to any attachment surface 103, including, but not limited to, the sink 101, a countertop, a cabinet, a wall, a temporary structure, a refrigerator, an appliance, etc. The attachment strip 72 may be installed facing upward in a brush standing position (FIG. 17), or the attachment strip 72 may be affixed to a bottom of a surface such that the magnetic bottle brushes 10 hang from the attachment strip 72 (hanging use position not shown). The attachment strip 72 may also be installed on the left or right side of a surface such that the magnetic bottle brush 10 extends horizontal and orthogonal from the attachment strip 72 (not shown). The attachment strip 72 may also be affixed to a surface in any intermediate position between vertical and horizontal for storing the magnetic bottle brush 10 in a desired position.

Figure 18:
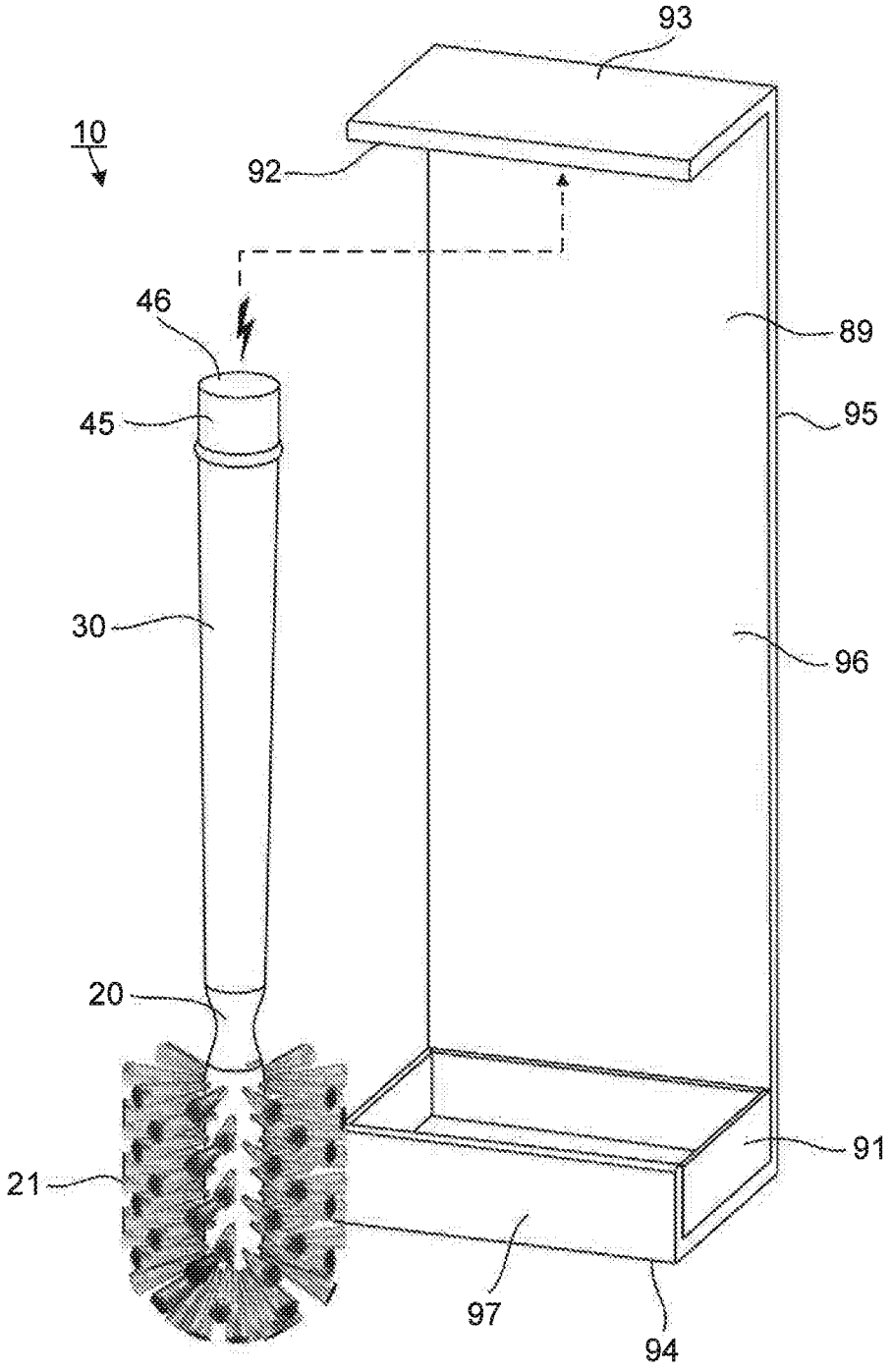
FIG. 18 illustrates a front perspective view of the magnetic bottle brush and a magnetic brush rack with a drip tray.

FIG. 18 illustrates the magnetic bottle brush 10 stored in a hanging position in a brush rack 89. The brush rack 89 is made from the ferromagnetic material 60 that is attracted by the magnetic attachment force of the magnet 40 disposed in the magnetic bottle brush 10 within the magnet housing 45. Alternatively, the brush rack 89 may be made of any suitable material with magnetic points of attachment 71 formed therein. The brush rack 89 has a top surface 93, a hanging surface 92, a bottom surface 94, a front surface 96 and a back surface 95. A drip tray 91 is disposed at the bottom of the brush rack 89 between the front surface 96 and a front ledge 97. The drip tray 91 collects liquid that may drip off the magnetic bottle brush 10 when it is attached therein. The brush rack 89 allows for easy storage of the magnetic bottle brush 10 in a hanging or standing configuration. While FIG. 18 shows a brush rack 89 configured for use with a single magnetic bottle brush 10, it is contemplated that the brush rack 89 may be made wider in order accommodate storage of more than one magnetic bottle brush 10.

Figure 19:
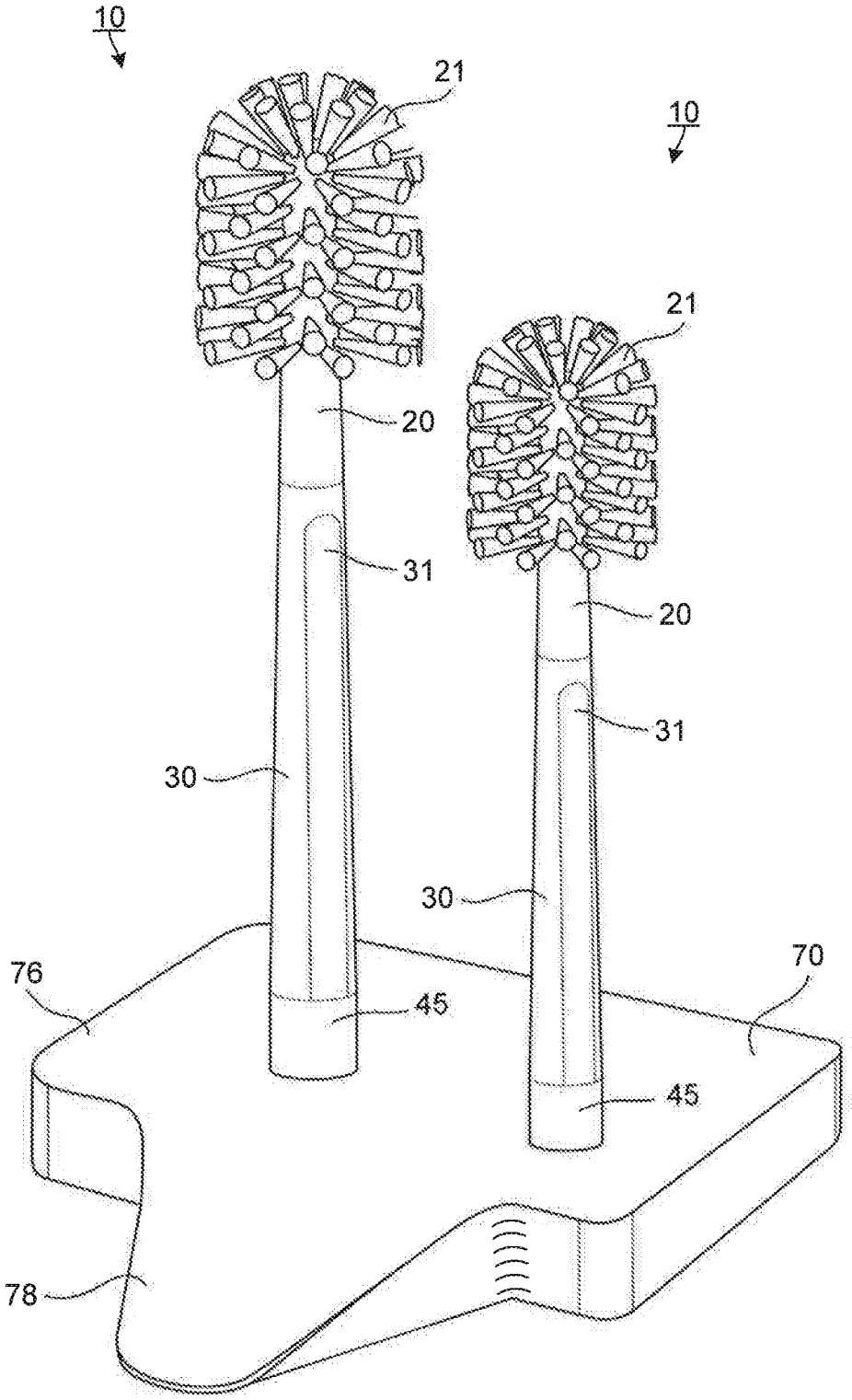
FIG. 19 illustrates a front perspective of two magnetic bottle brushes standing and attached to a magnetic brush tray.
Figure 20:
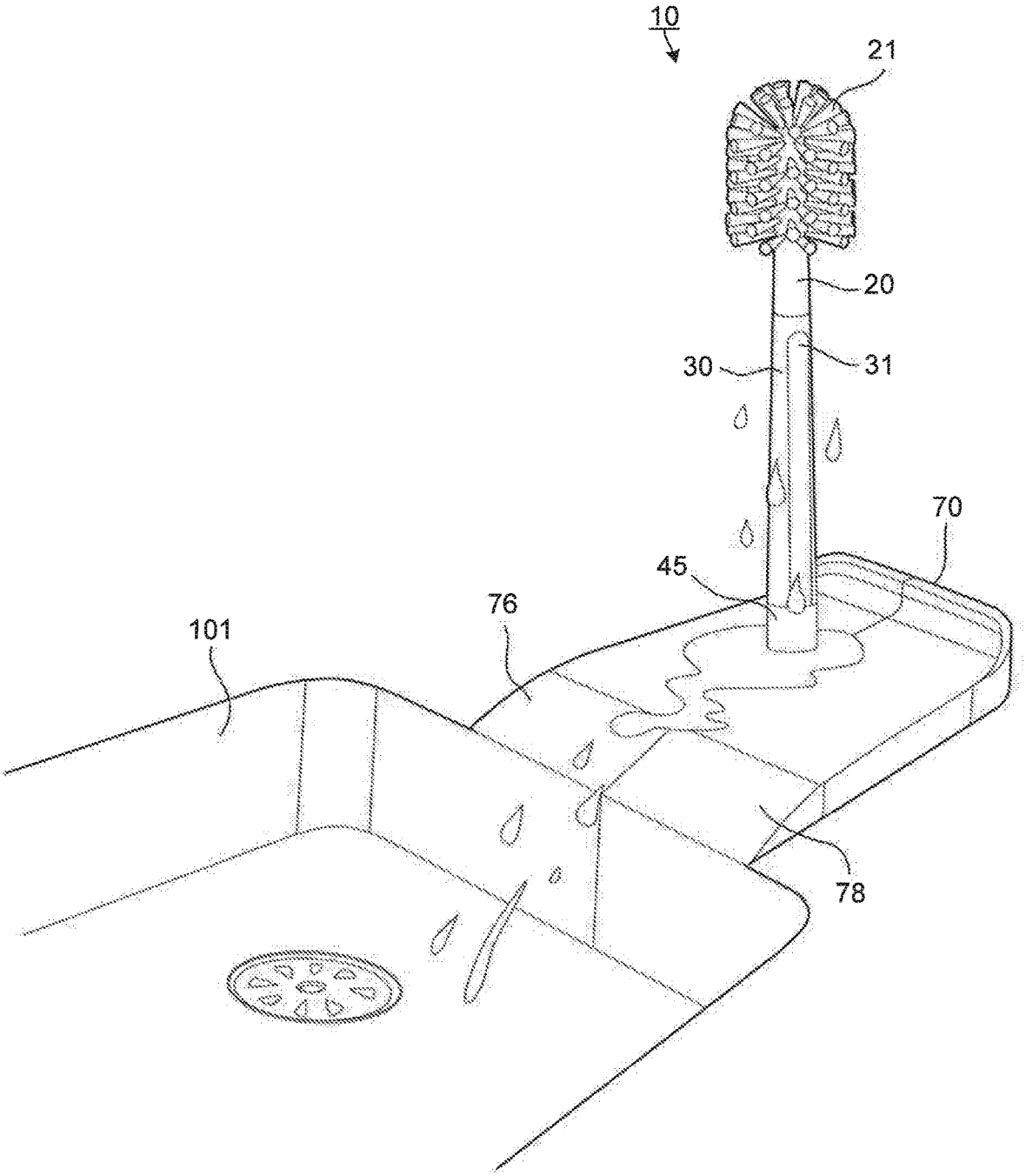
FIG. 20 illustrates a front perspective of a wet magnetic bottle brush standing and attached to the magnetic brush tray with the run-off water draining into a sink.

FIGS. 19-20 illustrate a brush tray 70 for attaching magnetic bottle brushes 10. The brush tray 70 is shown as having a flexible spout or gutter 78. The flexible spout 78 allows for the drainage of liquid that may pool in the brush tray 70 after storing the magnetic bottle brush 10 after use. The flexible spout 78 may be shaped as a funnel, trough, and/or any other shape that directs the drainage of liquid away from the brush tray 70. The brush tray 70 may be of a sufficient size to accommodate multiple magnetic bottle brushes 10. It is to be understood that the brush tray 70 may be of any size or geometric shape to accommodate at least one magnetic bottle brush 10. The brush tray 70 may be over-molded with a tray cover 76 that covers the brush tray 70. The tray cover 76 may protect the user from inadvertent harm during usage. The tray cover 76 may also protect the brush tray 70 from water damage. The tray cover 76 may be made of plastic, rubber and/or other similar materials resistant to water damage.

FIG. 20 illustrates a magnetic bottle brush 10 stored in the brush tray 70 that is positioned by the sink 101. As shown, the magnetic bottle brush 10 is wet, which leads to liquid dripping down towards the brush tray 70. The brush tray 70 then allows for the liquid to drain towards the flexible spout or gutter 78. The liquid then flows directly into the sink 101, which helps the brush tray 70 and the magnetic bottle brush 10 to dry more quickly.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed is:

1. A magnetic bottle brush assembly, comprising:

a magnetic bottle brush having:

a handle with an upper portion and a lower portion;

a brush head attached to the upper portion of the handle; and a magnetic element disposed in the lower portion of the handle that exerts a magnetic attraction force; and a magnetic base formed as a tray with a tray cover that has a liquid run-off channel disposed thereon, and that attaches to the magnetic bottle brush through the magnetic attraction force.

2. The magnetic bottle brush assembly of claim 1, further comprising a magnet housing encasing the magnetic element.

3. The magnetic bottle brush assembly of claim 2, wherein the magnet housing has an alignment shaft that orients and secures the magnetic element contained therein.

4. The magnetic bottle brush assembly of claim 1, wherein the magnetic element is a magnet.

5. The magnetic bottle brush assembly of claim 1, wherein the magnetic element is a ferromagnetic material.

6. The magnetic bottle brush assembly of claim 1, wherein the liquid run-off channel comprises a flexible spout or gutter.

7. The magnetic bottle brush assembly of claim 1, wherein the handle has a grip depression on the handle to provide leverage.

8. The magnetic bottle brush assembly of claim 1, further comprising a detachable nipple brush that is stored in the handle and contains the magnetic element.

9. The magnetic bottle brush assembly of claim 8, wherein the magnetic element additionally attaches the detachable nipple brush to the handle.

10. A magnetic bottle brush assembly, comprising:

a bottle brush having:

a handle with an upper portion and a lower portion;

a brush head attached to the upper portion of the handle; and a magnetic element disposed in the lower portion of the handle; and a magnetic base formed as a tray with a tray cover that has a liquid run-off channel disposed thereon, wherein a magnetic attraction force is generated to attract the first magnetic element of the bottle brush to the magnetic base.

11. The magnetic bottle brush assembly of claim 10, wherein the liquid run-off channel comprises a flexible spout or gutter.

12. The magnetic bottle brush assembly of claim 11, wherein the flexible spout is shaped as a funnel or trough.

13. The magnetic bottle brush assembly of claim 10, wherein the tray may be over-molded with the tray cover that covers the tray.

14. A magnetic bottle brush assembly, comprising:

a bottle brush having:

a handle with an upper portion and a lower portion;

a brush head attached to the upper portion of the handle; and a magnetic element disposed in the lower portion of the handle;

a magnetic base formed as a tray having:

a tray cover;

a liquid run-off channel disposed thereon;

wherein a magnetic attraction force is generated to attract the magnetic element of the bottle brush to the magnetic base.

15. The magnetic bottle brush assembly of claim 14, further comprising a magnet housing that encases the first magnet element.

16. The magnetic bottle brush assembly of claim 14, wherein the magnetic attraction force generated by the magnetic element supports the bottle brush in a horizontal position when attached to the magnetic base.

17. The magnetic bottle brush assembly of claim 14, wherein the attachment between the brush head and handle is magnetic and a second point of attachment for securing the bottle brush magnetically.

18. The magnetic bottle brush assembly of claim 14, wherein the liquid run-off channel comprises a spout or gutter.

* * * * *